US008475142B2

(12) United States Patent
Breuer et al.

(10) Patent No.: US 8,475,142 B2
(45) Date of Patent: Jul. 2, 2013

(54) PUMP HAVING A MAGNETICALLY ACTUATED CONTROL VALVE FOR SUCTION REGULATION

(75) Inventors: Peter Breuer, Friedrichsdorf (DE); Bernd Brunsch, Dreieich (DE); Stefan Gross, Eschborn (DE)

(73) Assignee: Ixetic Bad Homburg GmbH, Bad Homburg (DE)

( * ) Notice: Subject to any disclaimer, the term of this patent is extended or adjusted under 35 U.S.C. 154(b) by 895 days.

(21) Appl. No.: 12/529,305

(22) PCT Filed: Feb. 13, 2008

(86) PCT No.: PCT/EP2008/001100

§ 371 (c)(1),
(2), (4) Date: Aug. 31, 2009

(87) PCT Pub. No.: WO2008/107065

PCT Pub. Date: Sep. 12, 2008

(65) Prior Publication Data

US 2010/0098559 A1 Apr. 22, 2010

(30) Foreign Application Priority Data

Mar. 6, 2007 (DE) ..... 10 2007 010 694

(51) Int. Cl.
*F04B 53/10* (2006.01)
*F04B 53/18* (2006.01)

(52) U.S. Cl.
USPC ..... 417/295; 417/441; 417/505

(58) Field of Classification Search
USPC 91/491; 417/273, 295, 441, 505; 251/129.02, 251/129.06, 129.08, 325, 339, 344
See application file for complete search history.

(56) References Cited

U.S. PATENT DOCUMENTS

| | | | | | |
|---|---|---|---|---|---|
| 4,557,342 | A | * | 12/1985 | Drutchas | 180/442 |
| 5,156,531 | A | * | 10/1992 | Schmid et al. | 417/295 |
| 5,722,738 | A | | 3/1998 | Beck et al. | |
| 5,983,927 | A | | 11/1999 | Simon et al. | |
| 6,016,790 | A | | 1/2000 | Makino et al. | |
| 6,095,763 | A | * | 8/2000 | Bodzak et al. | 417/295 |
| 6,253,734 | B1 | | 7/2001 | Rembold et al. | |
| 2006/0278198 | A1 | | 12/2006 | Savage et al. | |

FOREIGN PATENT DOCUMENTS

| | | | |
|---|---|---|---|
| DE | 19834120 | A1 | 2/2000 |
| EP | 0 816 672 | A2 | 1/1998 |
| EP | 1273796 | A2 | 1/2003 |
| WO | WO-95/03198 | A1 | 2/1995 |

* cited by examiner

*Primary Examiner* — Charles Freay
*Assistant Examiner* — Philip Stimpert
(74) *Attorney, Agent, or Firm* — Harness, Dickey & Pierce, P.L.C.

(57) ABSTRACT

The invention relates to a pump comprising a pump unit, an intake line, and a valve device associated with same for implementing suction regulation of the pump, and comprising an intake region downstream from the valve device as viewed in the direction of flow of the medium conveyed by the pump.

19 Claims, 2 Drawing Sheets

PUMP HAVING A MAGNETICALLY ACTUATED CONTROL VALVE FOR SUCTION REGULATION

CROSS-REFERENCE TO RELATED APPLICATIONS

This application is a 371 U.S. National Stage of International Application No. PCT/EP2008/001100, file Feb. 13, 2008. This application claims the benefit of German Patent Application No. 10 2007 010 694.9, filed Mar. 6, 2007, which application is herein expressly incorporated by reference.

DESCRIPTION

The invention relates to a pump according to the preamble of claim 1.

Pumps of this type are known. They are used, for example, in hydraulic systems of motor vehicles in which a volumetric flow is to be provided independent of the pump rotational speed. In active suspension systems of motor vehicles such as roll stabilization systems, pumps for example, are used which provide a minimum volumetric flow when the internal combustion engine of the motor vehicle, which is also used to drive the pump, is idling, and which provide a limited maximum volumetric flow when a certain rotational speed of the pump is exceeded, for example during rapid driving. The limitation is provided on the one hand by internal suction throttling which acts through transverse boreholes in a piston, and on the other hand by suction throttling by means of a proportional valve, thereby allowing any desired characteristic curve to be adjusted. However, implementation is sluggish and costly. In another known suction throttling system, a rotatable disk in the intake line is used which changes the inlet cross section. However, in this case the complicated seal is disadvantageous.

The object of the invention, therefore, is to provide a pump which avoids these disadvantages.

This object is achieved by use of a pump having the features stated in claim 1, i.e., a pump unit comprising an intake line and a valve device associated with same, and an intake region situated after, i.e., downstream from, the valve device as viewed in the direction of flow of the medium conveyed by the pump. The pump is characterized in that a switching valve having a solenoid is used which achieves the suction throttling of the pump, i.e., influences the media flow passing from the intake line to the pump unit.

One exemplary embodiment is particularly preferred which is characterized in that the solenoid is actuated using a clocked current.

One exemplary embodiment is particularly preferred in which the duty cycle and/or the clock frequency of the current which are supplied to the solenoid may be varied. In this manner, despite use of a switching valve a variable volumetric flow passing from the intake line to the pump unit may be set.

In a further preferred exemplary embodiment it is provided that at the start of a switching operation the solenoid is acted on by an increased current, i.e., subjected to overcurrent, to overcome static friction of the solenoid anchor within the valve device. The current is then adjusted to the so-called holding current to avoid overheating of the valve device.

One particularly preferred exemplary embodiment is characterized in that the valve device has a spring apparatus which acts on a closing element with a force and pushes the closing element into its open position. In the event of a power failure this ensures that the closing element does not reduce the cross section of the intake line, and that the maximum volumetric flow to the pump is available. The elastic force of the spring apparatus is limited in such a way that the closing element may be displaced by the solenoid, against the force of the spring apparatus, into the at least one throttle position and into the closed position. Thus, the spring apparatus does not hinder normal operation of the valve device.

A further particularly preferred exemplary embodiment is characterized by a bypass unit. The bypass unit is used to ensure a minimum supply to the pump unit, even in the closed state of the closing element, so that the pump unit is adequately lubricated and cooled. The bypass unit may also be designed so that additionally or alternatively it supplies at least one bearing for the pump with a minimum volume of the conveyed medium, thus ensuring cooling and lubrication of the bearing. In any case, the shortest supply path is preferably selected.

An exemplary embodiment is also preferred in which a base of the intake line has a recess. This recess is preferably designed as a borehole. The recess passes through the base and extends to a region of an opening in a center plate in which the at least one bearing for the pump is situated. Via the recess the bearing for the pump is supplied with the medium which is conveyed by the pump and used as lubricant and/or coolant for the bearing.

Also preferred is an exemplary embodiment in which a separate channel or a separate line is provided via which coolant and/or lubricant is supplied to the recess, and thus, directly to the bearing. This ensures that motions of a piston for the valve device have no influence on the medium flowing to the recess, i.e., do not result in turbulence and/or foaming of the medium.

In a further preferred exemplary embodiment of the pump it is provided that the closing element is connected to the solenoid via a coupling member, the coupling member preferably resting loosely against the solenoid anchor. Thus, the position of the closing element is not directly associated with the configuration of the solenoid in the pump, so that the design of the pump is variable.

One exemplary embodiment of the pump is particularly preferred in which the closing element is situated inside the housing of the pump in such a way that the intake region downstream from the valve device is very small. In this manner, foam formation resulting from negative pressure during intake is reduced to a minimum.

In a further preferred exemplary embodiment, the closing element is designed as a sleeve having a cover with at least one opening. As a result of this opening, a minimum supply to the pump unit and/or to its bearing can be ensured, even when the closing element is in its closed position, because the opening is a part of the bypass unit.

Lastly, one particularly preferred exemplary embodiment of the pump is characterized in that the closing element includes plastic, and preferably is made of plastic. The closing element may thus have a very lightweight design, so that the switching speed of the valve device is very high.

Further designs result from the remaining subclaims.

The invention is explained in greater detail below with reference to the drawings, which show the following:

Figure 1:
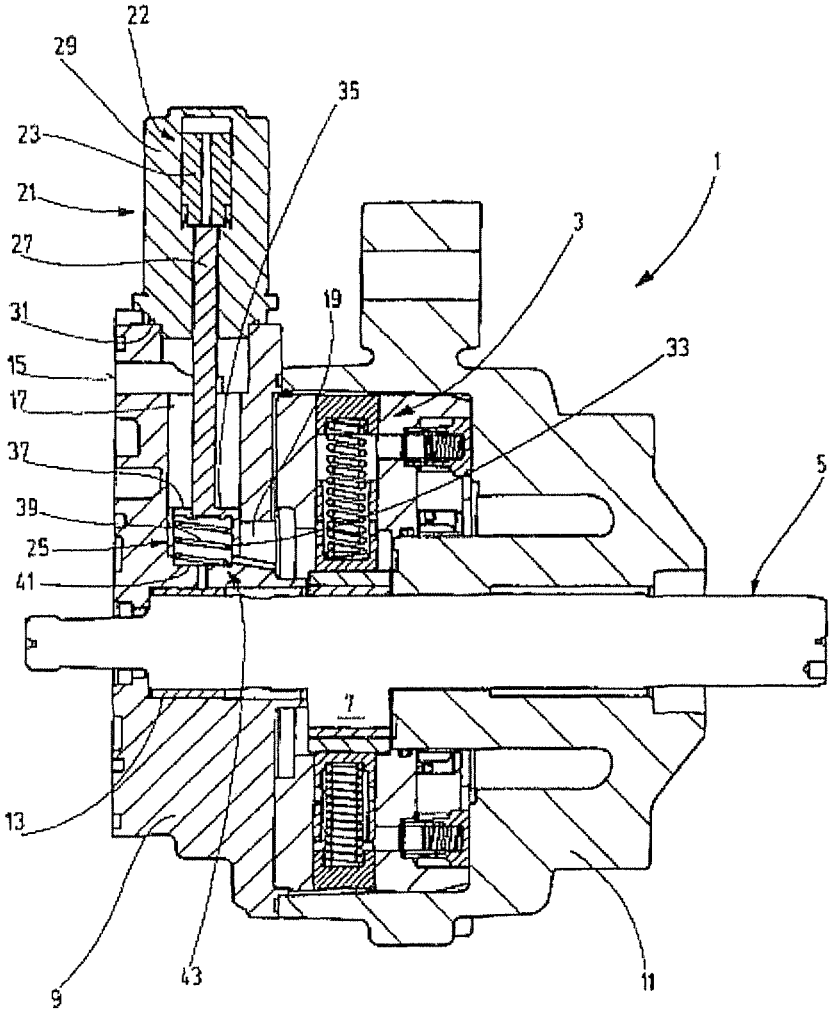
FIG. 1 shows a longitudinal view through a pump.

FIG. 1 shows a pump 1, including a pump unit 3, in a longitudinal section. In the exemplary embodiment illustrated, the pump is designed as a radial piston pump, and is driven by a shaft 5 which in the region of the pump unit 3 includes an eccentric 7 which pushes the pistons of the radial piston pump radially outward against the force of springs.

The in-and-out motion of the pistons causes a medium to be conveyed. Radial piston pumps are basically known, and therefore no further discussion of their design and function is provided here. However, it is noted that the pump unit 3 may also be designed as a vane cell pump unit, gear pump unit, or axial piston pump unit, the design and function of which are likewise known.

The pump unit 3 is enclosed by a housing for the pump 1, which in this case by way of example comprises a center plate 9 and a cover 11. The two parts are suitably joined together in a pressure-tight manner, for example by means of screws (not illustrated), and are penetrated by the shaft 5, which is supported in the center plate 9 via a bearing which by way of example is designed as a slide bearing 13.

The medium conveyed by the pump 1 enters into the housing of the pump 1, in this case into the center plate 9, through an inlet 15, an intake line 17 being provided in the center plate 9 through which the medium conveyed by the pump 1 passes to an intake region 19 situated directly upstream from the pump unit 3.

The pump 1 has a valve device 21, with a solenoid 22, associated with the intake line 17. The solenoid 22 includes a solenoid anchor 23 and a solenoid coil (not visible in the illustration). When the solenoid anchor 23 moves inside the valve device 21 this results in displacement of a closing element 25, which can assume a closed position, illustrated in FIG. 1, and also at least one throttle position and an open position. In the closed position the fluid connection between the intake line 17 and the pump unit 3 is almost completely interrupted.

In the present case the closing element 25 may be actuated by the solenoid anchor 23 via a coupling member 27, so that these two parts, the solenoid anchor 23 and the closing element 25, may be situated at a distance from one another, as illustrated in FIG. 1. The closing element 25 and the coupling member 27 are preferably designed as one piece. In particular, it is possible to situate the closing element 25 in the immediate vicinity of the pump unit 3 so that the intake region 19 has a comparatively small volume. Foaming of the fluid drawn in by the pump unit 3 under negative pressure may be minimized by reducing the intake region to a minimum. The pump 1 itself may be compactly designed as a result of providing the solenoid anchor 23 and the closing element 25 separately from one another.

Thus, in the preferred exemplary embodiment of the pump 1 illustrated here, the closing element 25 is situated in the immediate vicinity of the pump unit 3 and also close to the shaft 5, whereas a housing 29 for the valve device 21 which accommodates the solenoid anchor 23 and the associated solenoid coil (not illustrated) is situated at a distance from the intake region 19 and from the shaft 5, and can be externally mounted on the housing for the pump 1. In the present case the housing 29 for the valve device 21 is externally mounted on the center plate 9 and securely anchored in a suitable manner at that location. Since the valve device 21 itself is designed to be oil-tight, its housing 29 may be easily sealed with respect to the center plate 9, in this case, for example, by using a simple static O-ring seal 31. In the present case the coupling member 27 extends radially with respect to the shaft 5 and concentrically with the intake line 17, so that the closing element 25 may be radially inwardly situated at the end of the intake line 17, and thus separates the intake line from the intake region 19 when the closing element 25 is in its closed position as illustrated in FIG. 1. However, other configurations are also possible.

The closing element 25 is designed as a sleeve having a cylindrical wall region 33 which is displaceable in the direction of the center axis of the intake line 17, i.e., radially with respect to the shaft 5, and which in principle makes sealing contact with the inner wall of the intake line 17. At its end facing the coupling member 27 the closing element 25 has a cover 35 that is provided with at least one opening 37. It is also possible for the cover 35 to have three star-shaped arms by means of which the coupling member 27 is connected to the sleeve-shaped closing element 25. The at least one opening 37 is created by the interspaces in the arms. The fluid present in the intake line 17 is thus able to penetrate into the interior of the closing element 25, so that the fluid or the oil flow produces only small axial forces.

The valve device 21 has a spring apparatus 39, in the present case designed as a coil spring, whose outer diameter is selected so that the spring apparatus can be accommodated inside the cylindrical wall region 33 of the closing element 25. The coil spring presses from above against the base 41 of the intake line 17 facing the shaft 5, and from the bottom up against the closing element 25, in this case against the cover 35 thereof. The spring apparatus 39 is designed to push the closing element 25 into its open position, i.e., upward relative to the closed position illustrated in FIG. 1, thereby establishing a fluid connection between the intake line 17 and the intake region 19, in the present case by means of the at least one opening 37 in the cover 35 of the sleeve-shaped closing element 25. The elastic force of the spring apparatus 39 is designed so that the closing element 25 is displaced downward into the closed position illustrated in FIG. 1 when the solenoid anchor 23 of the valve device 21 is actuated, thereby overcoming the pretensioning force of the spring apparatus 39.

The spring apparatus 39 is thus designed so that on the one hand it does not hinder the functioning of the valve device 21, and on the other hand it pushes the closing element 25 into its open position in the event of interruption of power to the valve device 21. A fail-safe function is thus ensured which allows the pump unit 3 to convey a fluid to a consumer even when the valve device 21 fails.

The described spring apparatus 39 may also have a tension spring which acts on the closing element 25 from above and pulls it upward if the valve device 21 fails. The spring apparatus may engage directly with the closing element, or also with the coupling member 27. Lastly, it is also possible for a spring apparatus of this type to be integrated into the valve device 21, and for the solenoid anchor 23 inside the valve device 21 to be acted on by an upwardly directed elastic force so that, if needed, the closing element 25 may be displaced into its open position by means of the coupling member 27, thus ensuring the fail-safe function.

The valve device 21 has a bypass unit 43. The bypass unit ensures that supplying the pump unit 3 with the medium drawn in through the intake line 17 is possible when the closing element 25 is in the closed position shown in FIG. 1. Alternatively or additionally, the bearing 13 may be lubricated and cooled by the medium present in the intake line 17 by means of the bypass unit 43 when the closing element 25 is in its closed position. The design of the bypass unit 43 is described in greater detail below with reference to FIG. 2.

Figure 2:
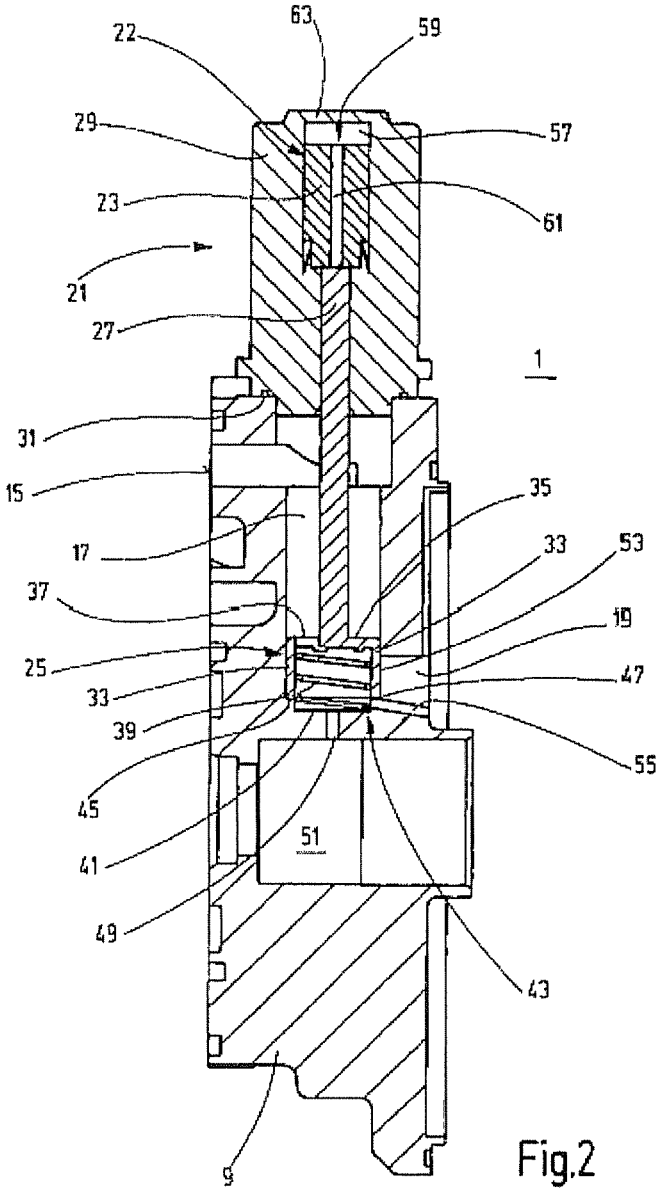
FIG. 2 shows an enlarged cross section of a valve device for the pump according to FIG. 1.

FIG. 2 shows an enlarged sectional view of a portion of the pump 1, namely, through the center plate 9 and the valve device 21. Identical parts already described with reference to FIG. 1 are provided with the same reference numerals, and are not discussed in detail in the present description. The shaft 5 and the bearing 13 are omitted in the illustration according to FIG. 2.

The enlarged illustration according to FIG. 2 shows that in the exemplary embodiment depicted here the bypass unit 43 has the following design: In its closed position shown in FIGS. 1 and 2 the closing element 25 is not pushed completely to the base 41 of the intake line 17. Rather, a shoulder 45 is provided which keeps the lower edge of the cylindrical wall region 33 of the sleeve-shaped closing element 25 at a distance from the base 41. The medium present in the intake line 17 is thus able to reach the intake region 19 at the lower edge 47 of the closing element 25. This medium passes from the intake line 17 through the at least one opening 37 in the cover 35 of the closing element 25 and into the interior space enclosed by the cylindrical wall region 33, and flows past the lower edge 47 and into the intake region 19. In this manner a minimum volumetric flow in the pump unit 3 (not illustrated in FIG. 2) of the medium conveyed by the pump 1 may be ensured, even when the closing element 25 is in its closed position.

FIG. 2 shows a recess, preferably a borehole 49, which passes through the base 41 of the intake line 17 and extends to the region of an opening in the center plate 9 in which the slide bearing 13 for the shaft 5 (not illustrated in the figure) is situated. A borehole (not illustrated) which preferably adjoins the borehole 49 is likewise provided in the slide bearing 13. The medium conveyed by the pump 1 is thus able to pass through the intake line 17 and the hollow closing element 25 and reach the slide bearing 13 and cool and lubricate same, even when the closing element 25 is in its closed position.

The slide bearing 13 may also be supplied with the cooling and lubricating medium via a separate channel or a separate line, so that motions of the valve piston or of the closing element have no effect on the lubricating oil flowing to the slide bearing 13. It may be provided that the slide bearing 13 is supplied with the medium via a borehole which is not directly connected to the region of the intake line 17 in which the closing element 25 is moved and which may cause turbulence and foaming of the medium. This borehole may be in fluid connection with the separate channel or the separate line.

In the exemplary embodiment illustrated here, via a circular or oblong borehole 53 the intake space 19 may open into the intake line 17, which in the closed position is closed off from the closing element 25. In addition to the borehole 53, the intake space 19 is open to a channel 55 leading to the intake line 17, the height of the channel being designed so that it is not closed off by the lower edge 47 of the closing element 25 when the latter is in the closed position and is resting on the shoulder 45.

In the exemplary embodiment of the closing element 25 illustrated and described here, to implement the bypass unit 43 the medium present in the intake line 17 is led via the interior of the sleeve-shaped closing element 25 and through the borehole 49 to the bearing 13, and is led via the channel 55 to the pump unit 3.

However, variations of the closing element 25 are possible. The closing element may be designed as a solid body which in the closed position separates the intake line 17 from the intake region 19. The bypass unit 43 may be implemented by providing grooves in the peripheral surface of the closing element and/or in the inner surface of the intake line 17, at least in the region where the closing element 25 is in its closed position, so that the medium present in the intake line 17 is able to flow outwardly around the closing element 25 and reach the bearing 13 and/or pump unit 3.

The closing element 25 is preferably made of plastic. The closing element may thus have a very lightweight design, so that the switching speed of the valve device 21 is very high. The coupling member 27 may also preferably be made of plastic.

To allow a high switching speed, other lightweight materials may be used to implement the coupling member 27 and/or the closing element 25.

The solenoid anchor 23 moves in a cavity 57 inside the housing 29 for the valve device 21. In the closed position of the closing element 25 illustrated in FIGS. 1 and 2 the solenoid anchor 23 is in its lower position, thus providing a partial volume of the cavity 57 above the solenoid anchor. When the solenoid anchor 23 is moved upward upon actuation of the valve device 21, i.e., when current flows through the solenoid coil, this results in compression of the medium present in the cavity 57. In the present case oil is preferably provided to lubricate the solenoid anchor 23. To prevent hindrance of the motion of the solenoid anchor 23 during an upward motion, a pressure compensation device 59 is provided which in this case includes a borehole 61 which passes through the base body of the solenoid anchor 23. The medium present above the solenoid anchor 23 is able to flow downward through this borehole while the solenoid anchor is moving upward. Correspondingly, pressure compensation may also occur when the solenoid anchor 23 is displaced downward.

Instead of or in addition to the borehole 61, channels may be provided in the inner surface of the cavity and/or in the outer surface of the solenoid anchor 23, through which the medium present in the upper part of the cavity 57 may flow downward when the solenoid anchor 23 moves upward.

During operation of the pump 1, the valve device 21 is actuated by a suitable control or regulation system (not illustrated). In this manner the solenoid coil of the solenoid 22 is acted on by a current.

The valve device 21 is designed so that when the solenoid coil is acted on by a current the solenoid anchor 23 is displaced into the position shown in FIGS. 1 and 2, so that it moves the closing element 25 downward into the closed position as shown in FIGS. 1 and 2. The valve device 21 is designed in such a way that the elastic forces of the spring apparatus 39 are overcome.

When the solenoid 22 is switched to a currentless state or is acted on by only low current, the spring apparatus 39 is able to move the solenoid anchor 23, and thus also the closing element 25 and the coupling member 27, upward. The closing element 25 thus reaches its open position, so that the maximum volumetric flow is able to pass through the inlet 15 and intake line 17 and into the intake region 19 and is available to the pump unit 3.

To achieve suction throttling of the pump 1 or pump unit 3, the solenoid coil of the solenoid 22 is acted on by a clocked current, and the solenoid anchor 23 is moved into a throttle position located between the closed position and the open position. This results in a controllable volumetric flow from the intake line 17 to the intake region 19, the intended volume being achieved by means of the clocked actuation of the solenoid 22. Any desired volumetric flow may be set by regulating the duty cycle or the clock frequency of the current supplied to the solenoid 22. Since the solenoid anchor 23 and the coupling member 27 are not fixedly connected to one another, the coupling member 27 does not necessarily have the same frequency or the same lift as the solenoid anchor 23.

If the control for the solenoid 22 fails, the valve device 39 pushes the closing element 25 upward into its open position so that the maximum volumetric flow is able to pass from the intake line 17 into the intake region 19 and thus to the pump unit 3. Thus, the maximum volumetric flow is not impaired if the valve device 21 fails. However, in that case the maximum volume delivered by the pump 1 cannot be further influenced, and is then dependent on the maximum valve opening.

By use of the suction throttling described herein, the maximum volumetric flow of the pump 1 may be limited to 12 L/min, for example, or to a desired value. Even in the closed position of the closing element 25 a minimum volumetric flow is provided via the bypass unit 43 which is available to the bearing 13 and/or pump unit 3. For example, in this case a volumetric flow of 1 L/min to 2 L/min may be provided.

Since the closing element 25 may be situated at a distance from the solenoid anchor 23, namely, due to the use of the coupling member 27, the volume of the intake region 19, and thus also foam formation in the conveyed fluid, may be reduced to a minimum. This system also greatly reduces the delay in response time of the valve device due to displacement of the oil that is present, or filling of the remaining intake space, resulting in optimal functioning of the pump 1.

To increase the response speed of the valve device 21, a higher current is supplied to the solenoid 22 at the start of a switching operation, i.e., when the closing element 25 is to be moved to the closed position. This provision of overcurrent overcomes the static friction of the solenoid anchor 23 in the cavity 57 and the static friction of the coupling member 27 in the housing 29 for the valve device 21, as well as the static friction of the closing element 25 inside the intake line 17.

The provision of overcurrent may be ended as soon as the solenoid anchor 23, the coupling member 27, and the closing element 25 are set in motion. No later than the time at which the closing element 25 reaches the closed position, the current supplied to the solenoid 22 is adjusted to the so-called holding current to prevent overheating of the valve device 21.

Also for the case for which the closing element 25 can be displaced from the closed position to its open position, such a provision of overcurrent may be carried out to ensure sufficient releasing forces for rapid upward displacement of the closing element 25, coupling member 27, and solenoid anchor 23.

List of Reference Numerals

1 Pump
3 Pump unit
5 Shaft
7 Eccentric
9 Center plate
11 Cover
15 Inlet
17 Intake line
19 Intake region
21 Valve device
22 Solenoid
23 Solenoid anchor
25 Closing element
27 Coupling member
29 Housing
31 O-ring seal
33 Cylindrical wall region
35 Cover
37 Opening
39 Spring apparatus
41 Base
43 Bypass unit
45 Shoulder
47 Lower edge 47
49 Borehole
51 Opening
53 Borehole
55 Channel
57 Cavity
59 Pressure compensation device
61 Borehole
63 Wall region

The invention claimed is:

1. A pump comprising:

a pump unit;

an intake line;

a valve device associated with the pump for implementing suction throttling of the pump; and an intake region downstream from the valve device as viewed in the direction of flow of a medium conveyed by the pump, the valve device including a switching valve having a solenoid for influencing a media flow passing from the intake line to the pump unit;

the valve device having a closing element displaceable by the solenoid and moveable between an open position, at least one throttle position, and a closed position, the closing element including a sleeve having a cylindrical wall region displaceable in a direction parallel to a center axis of the intake line, the closing element having a cover that is provided with at least one opening, the cover further having a plurality of arms through which a coupling member is connected to the closing element, the coupling member connected to the solenoid, the at least one opening created by interspaces between the arms, and wherein the medium present in the intake line is able to penetrate into an interior of the closing element through the at least one opening.

2. The pump according to claim 1, wherein the solenoid is actuated using a clocked current.

3. The pump according to claim 2, wherein at least one of a duty cycle and a clock frequency of the current may be varied.

4. The pump according to claim 1, wherein the solenoid is subjected to overcurrent and is then acted on by a reduced current at the start of a switching operation.

5. The pump according to claim 1, wherein the valve device has a spring apparatus which acts on the closing element with a force and pushes the closing element into the open position, an elastic force of the spring apparatus limited such that the closing element may be displaced by the solenoid, against the force of the spring apparatus, into the at least one throttle position and into the closed position.

6. The pump according to claim 1, further comprising a bypass unit ensuring supply at least to the pump unit even when the closing element is in the closed position.

7. The pump according to claim 6, wherein the bypass unit ensures supply to at least one bearing for the pump, even when the closing element is in the closed position.

8. The pump according to claim 7, wherein the at least one bearing is a slide bearing.

9. The pump according to claim 8, wherein a base of the intake line has a recess which passes through the base and extends to a region of an opening in a center plate in which the bearing is situated.

10. The pump according to claim 9, wherein the recess is a borehole.

11. The pump according to claim 9, wherein the recess is supplied with the medium for cooling and/or lubrication of the bearing via a separate channel or a separate line.

12. The pump according to claim 1, wherein the closing element is situated proximate the pump unit to minimize the intake region downstream from the closing element.

13. The pump according to claim 12, wherein the at least one opening is part of the bypass unit ensuring supply at least to the pump unit even when the closing element is in the closed position.

14. The pump according to claim 1, wherein the closing element includes plastic.

15. The pump according to claim 1, wherein the closing element is made of plastic.

16. The pump of claim 1, further comprising:

a center plate defining the intake line and housing the closing element; and a housing for the valve device, the solenoid disposed in the housing, the housing externally mounted on the center plate;

wherein the coupling member extends from the housing to the center plate.

17. A pump comprising:

a pump unit;

an intake line through which a medium conveyed by the pump passes to an intake region; and a valve device associated with the pump for implementing suction throttling of the pump, the intake region positioned downstream from the valve device as viewed in a flow direction of the medium conveyed by the pump, the valve device including a switching valve having a solenoid for influencing media flow passing from the intake line to the pump unit, the valve device having a closing element displaceable by the solenoid and moveable between an open position, at least one throttle position, and a closed position, the closing element including a cylindrical sleeve and a cover connected to the closing element, the cover having a plurality of arms and at least one opening through which the medium present in the intake line is able to penetrate into an interior of the closing element.

18. A pump comprising:

a pump unit;

an intake line through which a medium conveyed by the pump passes to an intake region; and a valve device associated with the pump for implementing suction throttling of the pump, the intake region positioned downstream from the valve device as viewed in a flow direction of the medium conveyed by the pump, the valve device including a solenoid, a closing element and a coupling member coupling the solenoid to the closing element, the solenoid for influencing media flow passing from the intake line to the pump unit, the closing element displaceable by the solenoid and moveable between an open position, at least one throttle position, and a closed position, the closing element including a sleeve and a cover carried at an end of the closing element, the cover having a plurality of arms and at least one opening through which the medium present in the intake line is able to penetrate into an interior of the closing element.

19. The pump of claim 18, further comprising:

a center plate defining the intake line and housing the closing element; and a housing for the valve device, the solenoid disposed in the housing, the housing externally mounted on the center plate;

wherein the coupling member extends from the housing to the center plate.

* * * * *